US007491041B2

(12) United States Patent
Imai et al.

(10) Patent No.: US 7,491,041 B2
(45) Date of Patent: Feb. 17, 2009

(54) MULTISTAGE ROOTS-TYPE VACUUM PUMP

(75) Inventors: Toshio Imai, Saku (JP); Hideaki Itou, Saku (JP); Masayuki Misaizu, Saku (JP)

(73) Assignee: Kashiyama Industries, Ltd., Tokyo (JP)

( * ) Notice: Subject to any disclaimer, the term of this patent is extended or adjusted under 35 U.S.C. 154(b) by 43 days.

(21) Appl. No.: 11/509,331

(22) Filed: Aug. 24, 2006

(65) Prior Publication Data

US 2007/0048162 A1 Mar. 1, 2007

(30) Foreign Application Priority Data

Aug. 24, 2005 (JP) ..... 2005-243032

(51) Int. Cl.
*F04C 2/00* (2006.01)
*F03C 2/00* (2006.01)

(52) U.S. Cl. ..... 418/9; 418/206.5

(58) Field of Classification Search ..... 418/9, 418/10, 201.1, 201.3, 206.1, 206.5, 212
See application file for complete search history.

(56) References Cited

U.S. PATENT DOCUMENTS 1,214,300 A * 1/1917 Grouvelle et al. ..... 418/9
4,943,214 A * 7/1990 Niimura et al. ..... 418/9
4,995,796 A * 2/1991 Kambe et al. ..... 418/9

FOREIGN PATENT DOCUMENTS

JP 62023501 A * 1/1987 ..... 481/9
JP 2000-45976 A 2/2000
JP 2000045976 A * 2/2000
JP 2002364569 A * 12/2002
JP 2003307192 A * 10/2003

* cited by examiner

*Primary Examiner*—Theresa Trieu
(74) *Attorney, Agent, or Firm*—TraskBritt

(57) ABSTRACT

The invention reduces power consumption and makes a rotor with ease. As illustrated in FIG. 2, a multistage roots pump (1) in the invention includes upstream rotors (R1a, R1b, R2a, R2b) having multiple teeth, supported by a pair of revolving shafts (A1, A2); and downstream rotors (R3a, R3b-R5a, R5b) having an identical number of teeth (31) with the upstream rotors, supported by revolving shafts (A1, A2). The discharge area formed by the outer periphery of the downstream rotors (R3a, R3b-R5a, R5b) and the inner periphewy of the pump chambers (P1-P5) is smaller than that of the upstream rotors (R1a, R1b, R2a, R2b).

5 Claims, 5 Drawing Sheets

MULTISTAGE ROOTS-TYPE VACUUM PUMP

TECHNICAL FIELD

The invention relates to a roots pump that transports gas by means of a pair of rotors supported by a pair of revolving shafts. In particular, it relates to a multistage roots pump wherein the rotors are designed in multiple stages.

BACKGROUND

Roots pumps are applied in semi-conductor manufacturing processes and liquid crystal panel manufacturing equipment includes rotors mounted on a pair of revolving shafts, respectively, to transport and discharge gas from pump chambers with sequentially decreasing volume.

In order to reduce power consumption when this kind of multistage roots pump operates at maximum operating pressure, it is necessary to reduce the discharge volume at back stage (downstream side of the gas travel path) especially at the final stage. The discharge volume is determined by the volume of space formed by valleys of rotors that have multiple teeth, and the internal surface of pump chambers where rotors are mounted.

With respect to the current multistage roots pumps, it is necessary to reduce the axial length of the pump chamber and the rotors to reduce the discharge volume since the shape of rotors supported by revolving shafts are identical (for example, referring to patent document No. 1 (Japanese Patent Laid-open Publication No. 2003-307192)). However, if the axial length of rotors, i.e., the rotor thickness, is extremely thin, strength of the rotors tends to decrease thus causing deformation. Therefore, there is a lower limit for the discharge volume at the back stage.

FIG. 5 is an illustration of lobe number of rotors and discharge area. FIG. 5A is an illustration of three-lobed involute profile rotor. FIG. 5B is an illustration of four-lobed involute-toothed rotor and FIG. 5C is an illustration of six-lobed involute-toothed rotor.

The technology for solving the problem as described herein below in patent document No. 2 (Japanese Patent Laid-open Publication No. 2002-364569) is well known.

As described in patent document No. 2, the rotor at the front stage (upstream side) consists of three lobes, while the rotor at the back stage (downstream side) consists of five lobes. Through application of this kind of structure, the discharge volume is reduced by decreasing the discharge area of rotors at back stage.

Specifically, as shown in FIG. 5, regarding the widely used conventional rotor with involute-shaped teeth, wherein the radii of reference circle 01 are identical, the total discharge area (patterned area S02×4 sections in FIG. 5B) of a four-lobed rotor is approximately 78% of the total discharge area (patterned area S01×3 sections in FIG. 5A) of a three-lobed rotor, and the total discharge area (patterned area S03×6 sections in FIG. 5C) of a six-lobed rotor is approximately 53% of that of the three-lobed rotor. As a result, since it can reduce discharge area by increasing the lobe number of a rotor at back stage, it is possible to reduce discharge volume without reducing rotor thickness, as described in patent document No. 2.

Patent document No. 1: Patent Laid-open Publication No. 2003-307192 (FIGS. 8 and 9)

Patent document No. 2: Patent Laid-open Publication No. 2002-364569 (Paragraphs 0009-0015, FIG. 1-FIG. 3)

However, in traditional technology as described in patent document No. 2, there are more lobes at the back stage of the rotor, resulting in longer manufacturing time for the rotor at the back stage.

In particular, in the case of manufacturing rotors of a roots pump, a rotor cutting sheet such as a round sheet is fixed axially with good precision, and then the round sheet is cut by means of a cutting tool to make rotors in order to increase precision of distance between axial rotors. However, if the lobe number of rotors mounted on the same shaft is different, cutting operation will be complicated and it will take more time for machining.

In the case that a rotor is manufactured before fixed on the shaft, it is difficult to obtain precision of axial position. In addition, extremely high precision is required since each rotor needs to be fixed while the rotor phase is adjusted at good precision in order to secure rotor interlock on all twin rotors at multiple stages with precision. Furthermore, as described in patent document No. 2, in the case of rotors having different lobe number, interlock position is different at front stage than at back stage. Therefore, phase adjustment is particularly complicated, and it is also difficult to obtain precision and carry out assembly.

SUMMARY OF INVENTION

The invention reduces power consumption of a pump and makes rotors at ease.

In order to solve the technical problems, the multistage roots pump described in the invention is designed to comprise the following sections: a casing containing multiple pump chambers; a pair of revolving shafts supported by the casing; an upstream rotor mounted within the pump chamber on the upstream side of the gas travel path, supported by each of the revolving shaft and having multiple teeth as the upstream rotor; a downstream rotor mounted within the pump chamber on the downstream side of the gas travel path, supported by each of the revolving shaft, having identical number of teeth with the upstream rotor, and the discharge area formed by the outer periphery of the downstream rotor and the inner periphery of the pump chamber is smaller than that of the upstream rotor.

The pair of revolving shafts of the multistage roots pump is supported by the casing that contains multiple pump chambers. The upstream rotor having multiple teeth and supported by each revolving shaft is arranged within the pump chamber of the upstream side of the gas travel path. The downstream rotor mounted within the pump chamber on the downstream side of the gas travel path, supported by the each revolving shaft, having the same number of teeth as the upstream rotor. The discharge area formed by the outer periphery of the downstream rotor and the inner periphery of the pump chamber is smaller than that of the upstream rotor.

Accordingly, since the discharge area of downstream rotor in the case of the multistage roots pump of the invention is smaller than that of the upstream rotor, it can reduce discharge volume at the downstream side, thus reducing power consumption. Additionally, because the upstream rotor and downstream rotor have identical lobe number, compared with the case when rotors of different lobe number are applied, it is easy to manufacture rotors having identical lobe number and manufacturing time is reduced. Furthermore, in the case of identical lobe number, the interlock engaged position of the interlocked twin rotors is the same, so that phase coincidence is easy to obtain and assembly is easy to carry out. As a result, for the multistage roots pump in the invention, it is easy to manufacture rotors at reduced cost.

In the first form of the invention, a multistage roots pump comprises multiple upstream rotors and multiple downstream rotors. The upstream rotors are arranged at multiple stages and the downstream rotors are also arranged at multiple stages. Accordingly, it can reduce discharge volume at downstream side and increase gas compression performance.

In a second form of the invention, a multistage roots pump comprises upstream rotors and downstream rotors. The upstream rotor are formed by a profile having involute curve or cycloidal curve and the downstream rotors are formed by a profile having envelope curve in contrast with the involute curve or cycloidal curve. In this form, the upstream rotors are formed by a profile having involute curve or cycloidal curve, and the downstream rotors are formed by a profile having envelope curve instead of the involute curve or cycloidal curve. Accordingly, in the second form of the invention, the upstream rotors comprise so-called involute toothed rotors or cycloidal toothed rotors, and the downstream rotors comprise the envelope toothed rotors instead of the involute toothed rotors or cycloidal toothed rotors.

DESCRIPTION OF THE FIGURES

FIG. 2 illustrates the cross section of the multistage roots pump in FIG. 1.

FIG. 3 illustrates the rotors of the multistage roots pump in embodiment of the invention

FIG. 4 is an illustration of the rotors.

FIG. 5 is an illustration of lobe number of rotors and discharge area.

DETAILED DESCRIPTION OF THE INVENTION

The foregoing description of the invention makes it possible to reduce power consumption and enable rotor manufacture to be carried out with ease. Moreover, the discharge efficiency is increased and at the same time the rotor length is shortened.

Symbols used throughout the Specification and FIGs are explained as follows.

1 . . . multistage roots pump,

21, 21' . . . tooth

28 . . . involute curve

31, 31" . . . tooth

31*a* . . . arc

32*a* . . . envelop curve

A1, A2 . . . revolving shaft

C . . . casing

HM1, HM1", HM2, HM2" . . . discharge area

P1-P5 . . . pump chamber

R1*a*, R1*b*, R2*a*, R2*b*, R1*a*', R1*b*', R2*a*', R2*b*' . . . upstream rotor R3*a*, R3*b*, R5*a*, R5*b*, R3*a*", R3*b*"-R5*a*", R5*b*" . . . downstream rotor Embodiments of applications of the invention are illustrated with accompanying drawings as follows. It should be understood that application of the invention is not limited to the following embodiments.

Figure 1:
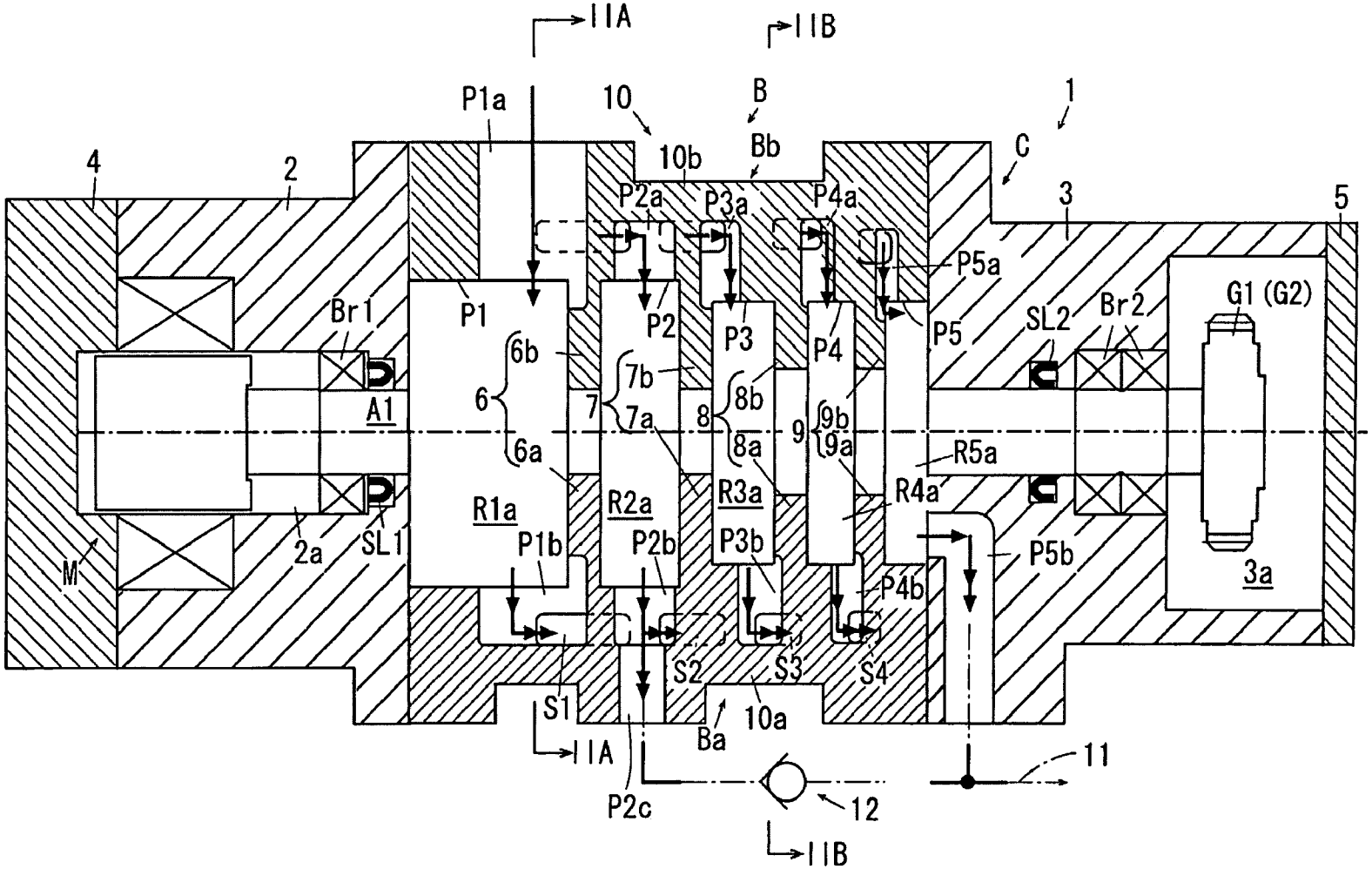
FIG. 1 is the longitudinal section of the multistage roots pump in the first embodiment of the invention.
Figure 2A:
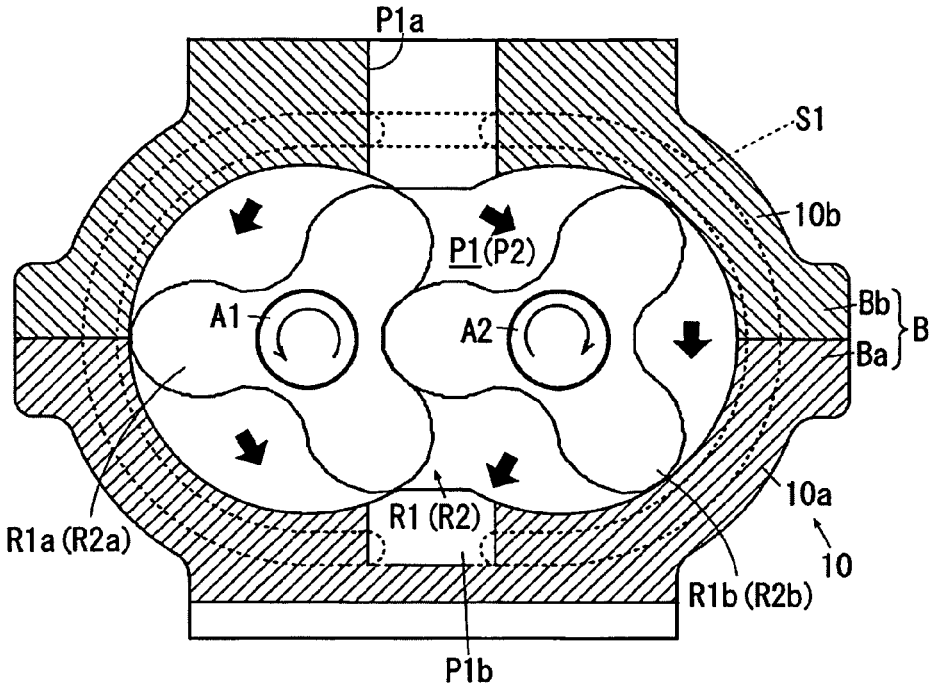
FIG. 2A is a sectional view taken along the line of IIA-IIA of FIG. 1.
Figure 2B:
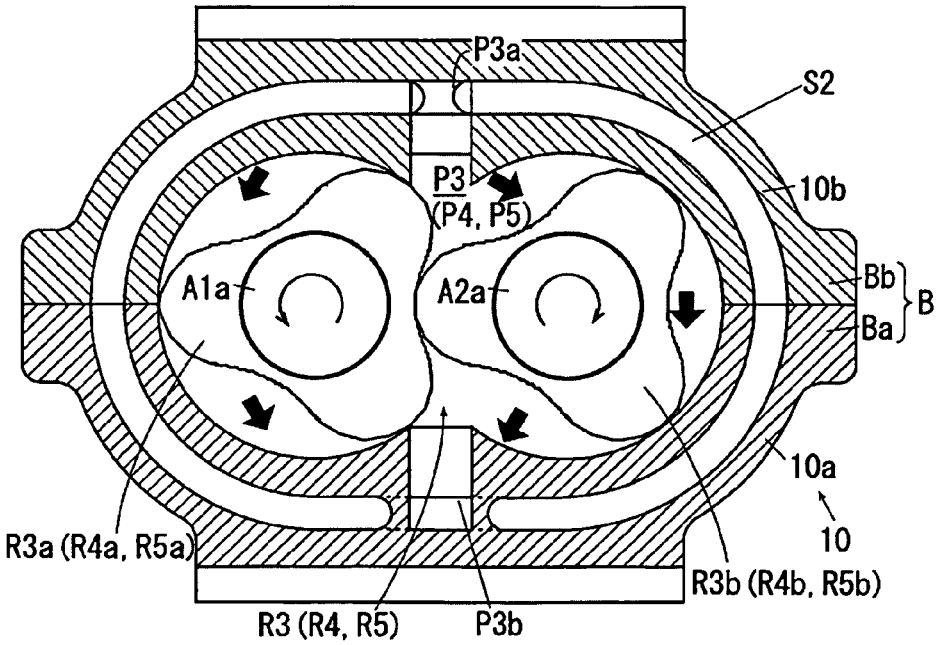
FIG. 2B is a cross-sectional view taken along the line of IIB-IIB of FIG. 1.

The first Embodiment of the invention is further explained as follows. FIG. 1 is the longitudinal section of the multistage roots pump in embodiment of the invention. FIG. 2 illustrates the cross section of the multistage roots pump in FIG. 1. FIG. 2A is a cross-sectional view taken along the line of IIA-IIA of FIG. 1. FIG. 2B is a cross-sectional view taken along the line of IIB-IIB of FIG. 1. In FIGS. 1 and 2, multistage roots pump 1 has upstream end wall 2 and downstream end wall 3 that are mounted separately. Motor M is housed within motor chamber 2*a* that is defined on the outer surface of the end of upstream end wall 2, and the outer end of motor chamber 2*a* is blocked by upstream end cover 4. The bearing Br1 that rotationally supports the end of drive shaft A1 and sealing part SL1 that prevents gas intake are mounted within the inner side of the motor chamber.

On the outer surface of downstream end wall 3, gear room 3*a* (referring to FIG. 1) is defined, which houses gear G1 mounted on drive shaft and gear G2 (not shown in the drawings) mounted on the driven shaft A2 (referring to FIG. 2) as well as lubricating oil. The outer end of gear room 3*a* where gear G1 and gear G2 are housed is blocked by downstream cover 5. Bearing Br2 that rotationally supports drive shaft A1 and sealing part SL2 that prevents the influx of gas and lubricating oil, are mounted on the inner side of the downstream end wall.

Partition block B is mounted between end walls 2 and 3, and partition block B comprises lower block Ba and upper block Bb. Partition block B includes multiple partition walls 6, 7, 8, 9 and outer walls 10, while lower block Ba comprises lower partition walls 6*a* to 9*a* that are the lower half of partition walls 6 to 9, and lower outer wall 10*a* that is the lower half of outer wall 10; upper block Bb comprises upper partition walls 6*a* to 9*a* that are the upper half of partition walls 6 to 9, and upper outer wall 10*a* that is the upper half of outer wall 10. Pump chambers No. 1 to No. 5 are generated respectively between end walls 2 and 3 as well as partition walls 6 to 9. In addition, casing C is defined by end walls 2 and 3, partition block B, upstream cover 4 and downstream cover 5.

On casing C, gas suction inlets P1*a* to P5*a* that are respectively connected to the upper end of each pump chamber P1 to P5, and gas discharge outlets P1*b* to P5*b* that are respectively connected to the upper end of each pump chamber are defined. Moreover, connecting channels S1 to S4 that connect discharge outlets P1*b* to P4*b* on upper stream pump chambers P1 to P4 with suction inlets P2*a* to P5*a* on the downstream pump chambers respectively are defined on the outer periphery of partition walls 6 to 9. Discharge outlet P5*b* on No. 5 pump chamber P5 at the final stage is connected with discharge passage 11 from which gas is discharged. In FIG. 1, mid-stage discharge outlet P2*c* is defined at downstream end of No. 2 pump chamber P2, and mid-stage discharge outlet P2*c* is connected with discharge passage 11 by means of inverted valve 12. As a result, inverted valve 12 opens for gas to discharge from mid-stage discharge outlet P2*c* when air pressure at mid-stage discharge outlet P2*c* is high right after discharge starts; when gas discharge continues, air pressure becomes low so that the inverted valve closes to allow gas to discharge from discharge outlet P5*b* of No. 5 pump chamber.

As shown in FIG. 2, with respect to pump 1 in the first embodiment of the invention, parallel drive shaft A1 and driven shaft A2 (referring to FIG. 2) are rotationally supported going through pump chamber partition walls 2, 6-9 and 3 with drive shaft A1 rotationally driven by motor M. The interlocked gear G1 and G2 are mounted on drive shaft A1 and driven shaft A2 within the said gear room 3*a*. Accordingly, as drive shaft A1 (revolving shaft) rotates, driven shaft A2 (revolving shaft) rotates through gear G1 and G2.

Pump rotors R1*a*, R1*b*-R5*a* and R5*b* that are housed within pump chambers P1 to P5 respectively are fixed on drive shaft A1 and driven shaft A2. Each of pump rotors R1*a*, R1*b*-R5*a* and R5*b* rotate integrally with drive shaft A1 and driven shaft A2. As they rotate, gas inhaled from suction inlets P1*a* to P5*a* of each pump chambers P1 to P5 is transported to discharge outlets P1*b* to P5*b*.

Figure 3A:
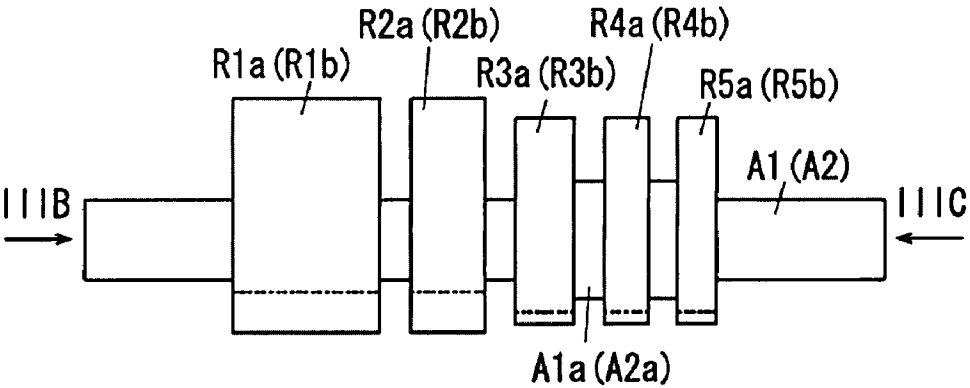
FIG. 3A is a side view.
Figure 3B:
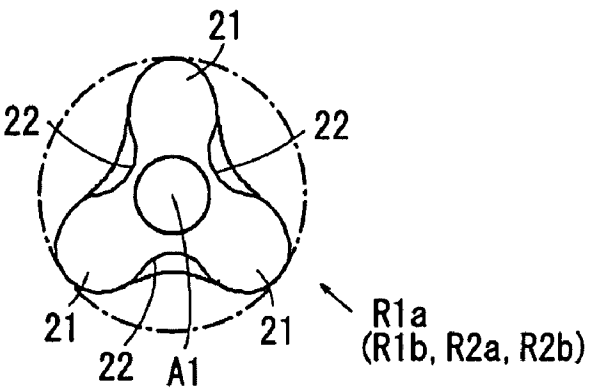
FIG. 3B illustrates the view taken from the direction of arrow IIIB in FIG. 3A.
Figure 3C:
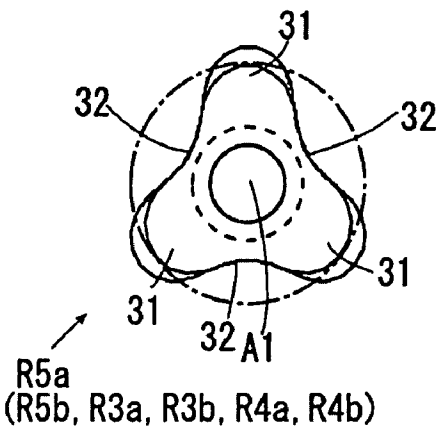
FIG. 3C illustrates the view taken from the direction of arrow IIIC in FIG. 3A.
Figure 4A:
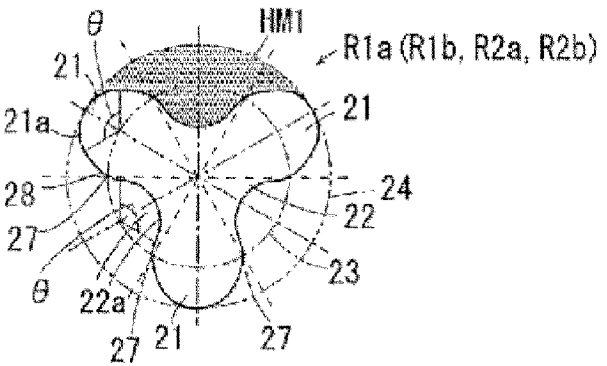
FIG. 4A is an illustration the upstream rotors in embodimentof the invention.
Figure 4B:
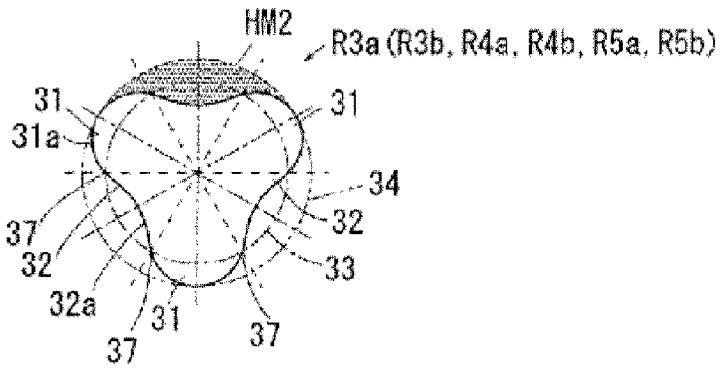
FIG. 4B is an illustration the downstream rotors in embodiment of the invention.
Figure 4C:
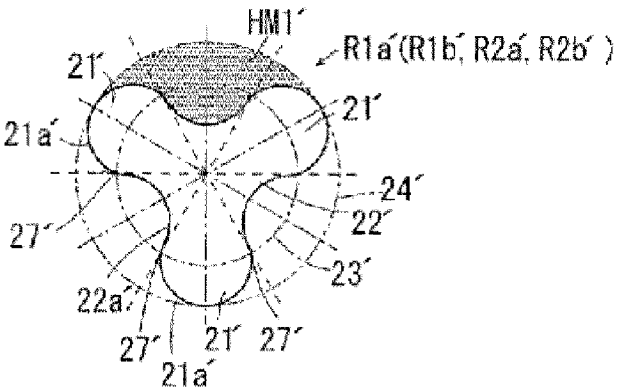
FIG. 4C illustrates the rotors in variation of the first embodiment of the invention.
Figure 4D:
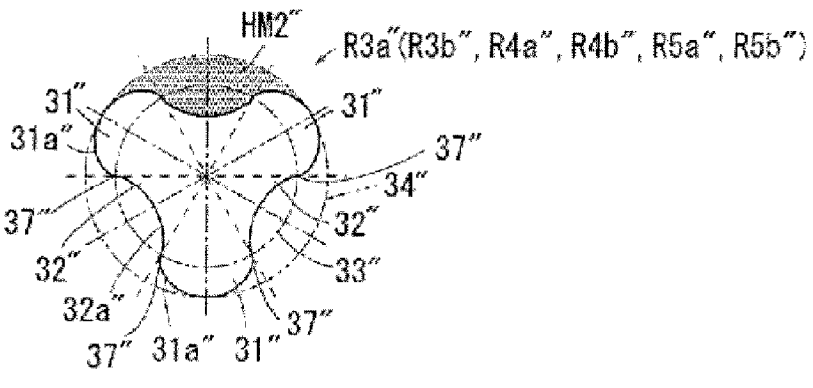
FIG. 4D illustrates the rotors in a second variation of the first embodiment of the invention.
Figure 5A:
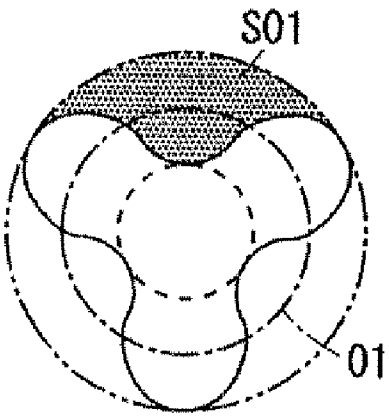
FIG. 5A (PRIOR ART)
FIG.5A is an illustration of three-lobed involute-toothed rotor.
Figure 5B:
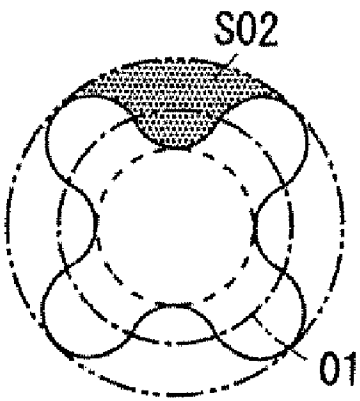
FIG. 5B (PRIOR ART)
FIG. 5B is an illustration of a four-lobed involute-toothed and FIG. 5C is an illustration of six-lobed involute-tooth rotor.
Figure 5C:
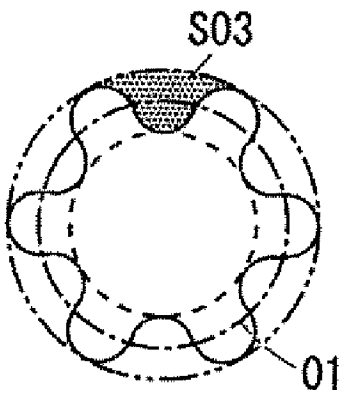
FIG. 5C (PRIOR ART)

FIG. 3 illustrates the rotors of the multistage roots pump in the first embodiment of the invention. FIG. 3A is a side view. FIG. 3B illustrates the view taken from the direction of arrow IIIB in FIG. 3A. FIG. 3C illustrates the view taken from the direction of arrow IIIC in FIG. 3A. FIG. 4 is an illustration of the rotors. FIG. 4A is an illustration of the upstream rotors in the first embodiment of the invention. FIG. 4B is an illustration of the downstream rotors in the first embodiment of then invention. FIG. 4C illustrates the rotors in variation of the first embodiment of the invention. FIG. 4D illustrates the rotors in variation of the first embodiment of the invention.

As shown in FIGS. 1 through 3, with respect to pump 1 of the first embodiment of the invention, No. 1 pump rotors R1*a*, R1*b* and No. 2 pump rotors R2*a*, R2*b*, acting as upstream rotors and supported by drive shaft A1 and driven shaft A2, comprises rotors of the same profile but of different axial thickness (with No. 2 pump rotors R2*a* and P2*b* of smaller thickness). Referring to FIGS. 2, 3 and 4A, it is shown that each of the upstream rotors R1*a*, R1*b*, R2*a*, R2*b* comprises three-lobed rotors that have three lobes 21 (tooth, tooth crest) and three valleys 22 (tooth root), with a profile composed of involute toothed rotor that is generally widely applied.

As shown in FIG. 4A, the profile of involute toothed upstream rotors R1*a*, R1*b*, R2*a* and R2*b* is formed as follows. First, define a reference circle 23 (referring to dot dash line in FIG. 4A); next, draw three straight radial lines (referring to the straight line of dot dash line in FIG. 4A) uniformly spaced (a space of 120° in the case of three lobes) from the center of reference circle 23, each straight line joins reference circle 23 at a crosspoint that is taken as the center point of lobe 21, while the crosspoint at the other side is taken as the center point of valley 22. In addition, arcs 21*a* and 22*with arc degree of* 120° (arc radius approximately 0.45 of that of reference circle 23) from each corresponding center. Six bisector lines of angle between the angles of the three straight radial lines are drawn, the cross-points where the said bisector lines intersect reference circle 23 are taken as points of connection 27. Arcs 21*a* and 22*a* are connected through involute 28 (evolvent), which goes through point of connection 27.

Accordingly, upstream rotors R1*a*, R1*b*, R2*a* and R2*b* in the first embodiment of the invention comprises three-lobed involute toothed rotor having a profile formed by arcs 21*a*, 22*a* and involute curve 28 that compensates the area between arcs 21*a*, 22*a*. As each twin R1 and R2 rotate, lobe 21 of one rotor interlocks with valley 22 of the other rotor to rotate (referring to FIG. 2A). When the space formed between rotor valley 22 and the internal surface of pump chambers P1 and P2 moves from suction inlets P1*a* and P2*a* to discharge outlets P1*b* and P2*b*, gas within the space is transported to the downstream side. Furthermore, as shown in FIG. 4A, discharge area HM1 of upstream rotors R1*a*, R1*b*, R2*a* and R2*b* is defined as the area (referring to patterned area in FIG. 4A) formed by rotor outside circle 24 (corresponding to the internal profile of the pump chamber) that connects the tips of lobe 21, arcs 21*a* and 22*a* as well as involute curve 28.

As shown in FIGS. 1 through 3, on pump 1 of the first embodiment of the invention, acting as downstream rotors, the No. 3 pump rotors R3*a*, R3*b* and No. 5 pump rotors R5*a*, R5*b* that are supported by drive shaft A1 and driven shaft A2 comprise rotors of the same profile with axial thickness decreases along the downstream side. As shown in FIGS. 2, 3 and 4, similar to the case with upstream rotors R1*a*, R1*b*, R2*a* and R2*b*, the downstream rotors R3*a*, R3*b*-R5*a* and R5*b* comprise three-lobed rotors that have three lobes 31(tooth) and three valleys 32. The discharge area HM2 (referring to patterned area in FIG. 4B) of downstream rotors R3*a*, R3*b*-R5*a* is defined as smaller than the discharge area HM1 of upstream rotors R5*b* R1*a*, R1*b*, R2*a* and R2*b*.

As shown in FIG. 4B, downstream rotors R3*a*, R3*b*-R5*a*, R5*b* have the following profile. Similarly to the case with the involute toothed rotor, first, set a reference circle 33 (referring to the dot dash line in FIG. 4B); second, set the tip of lobe 31 and point of connection 37. Thereby the profile is defined by arc 31*a* passing through the tip of lobe 31 and the point of connection 37 at both sides, and also through the envelope curve 32*a* formed by arc 31*a* of interlocked lobes of the twin rotors.

In addition, radius of reference circle 33 is defined to be the same as reference circle 23 in the first embodiment of the invention, with radius of rotor 34 as 1.25 times of that of reference circle 33. The total discharge area of downstream rotors R3*a*, R3*b*-R5*a*, R5*b* in the first embodiment 1 (discharge area HM2×3) is 52% of the total discharge area of upstream rotors R1*a*, R1*b*, R2*a*, R2*b*. R5*b* (discharge area HM1×3).

Therefore, downstream rotors R3*a*, R3*b*-R5*a*, R5*b* in the first embodiment of the invention comprise three-lobed rotors with a profile composed of arcs 31*a* and 32*a*. As each of the twin rotors R3-R5 rotate, lobe 31 of one rotor interlocks with the valley 32 of the other rotor to rotate (referring to FIG. 2B), and when the space formed between rotor valley 32 and the internal surface of pump chambers P3-P5 moves from suction inlets P3*a* and P3*a* to discharge outlets P3*b* and P3*b*, gas within the space is transported to downstream side.

Furthermore, with respect to pump 1 in the first embodiment of the invention, the outside diameters of the drive shaft A1*a* and driven shaft A2*a* fixed with No. 3 pump rotors R3*a*, R3*b*□No. 5 pump rotors R5*a*, R5*b* are bigger.

With respect to multistage roots pump 1 that has the structure described in the first embodiment of the invention, as revolving shafts A1 and A2 rotate driven by motor M, each twin rotors R1-R5 rotates, and then gas within each pump chamber P1-P5 is transported form suction inlets P1*a*-P5*a* to discharge outlets P1*b*-P5*b*. Transported gas is compressed corresponding to the volume ratio of each pump chamber P1-P5 and finally discharged through discharge passage 11.

Regarding pump 1 in the first embodiment of the invention, since discharge area of twin rotors R1-R5 at the downstream side is small, and furthermore, thickness turns smaller as it goes towards the downstream side, therefore discharge volume from discharge outlets P1*b*-P5*b* becomes less as it goes towards the downstream side; thereby resulting in saving of power and reduction of running cost.

In addition, since discharge area becomes small approaching the downstream side, while setting the discharge volume which is defined on the basis of discharge area and thickness, it can reduce discharge volume at the downstream side even with the thickness not thin enough. Accordingly, since it is able to secure thickness while reducing discharge volume, pump rotors R1*a*, R1*b*-R5*a*, R5*b* are strong and thus reduce deformation and wear.

Furthermore, on pump 1 of the first embodiment of the invention, upstream twin rotors R1 and R2, as well as downstream twin rotors R3-R5 comprise rotors of the same three-lobed rotors with lots of similarity in profile as shown in FIGS. 3B and 3C. Therefore, in the case of making rotors R1*a*, R1*b*-R5*a*, R5*b* from a cutting sheet that is fixed on revolving shafts A1 and A2, for instance, since cutting tool moves axially to cut the same profile, one can perform cutting operation by means of move cutting tool from upstream side to make upstream rotors R1*a*, R1*b*, R2*a*, R2*b*, and similarly from downstream side to make downstream rotors R3*a*, R3*b*-R5*a*, R5*b*. On the contrary, in the case of different number of lobes as with the prior art described in patent document No. 2, little in similarity and more in imparity result in long cutting time. As a result, compared with the case with different number of lobes, one can make the rotors R1*a*, R1*b*-R5*a*, R5*b* in the first embodiment of the invention in short time, thereby enable reduction of machining and manufacturing cost.

Apart from the forgoing, on pump 1 of the first embodiment of the invention, since there is lots of similarity in the profile of rotors R1*a*, R1*b*-R5*a*, R5*b*, one can use a cutting sheet of little allowance for finish (for instance, triangular sheet instead of round sheet in the case of three-lobed rotor). On the other hand, when the lobe number is different, the little similarity results in the need to use round sheet or polygonal sheet if the same sheet is used, therefore, allowance for finish is big in this case. As a result, with respect to pump 1 in the first embodiment of the invention, one can perform cutting through a sheet of little allowance for finish so as to reduce machining time. In addition, little allowance for finish result in reduction in cutting thereby reduces waste and manufacturing cost.

Additionally, on pump 1 of the first embodiment of the invention, since rotors R1*a*, R1*b*-R5*a*, R5*b* have as few as three lobes, one can apply a relatively big cutting tool, thereby make it easy to perform machining and reduce machining time. In addition, when the lobe number at upstream side and downstream is different, it is necessary to use different cutting tools; however, with respect to pump 1 in the first embodiment of the invention, upstream and downstream rotors R1*a*, R1*b*-R5*a*, R5*b* are of same lobe number, one can cut using the same cutting tool, thus resulting in the ease of cutting operation and cost control.

Additionally, since the lobe number is the same at the upstream and the downstream side, twin rotor R1-R5 are interlocked at the same interlock position, phase adjustment and the assembly of pump 1 is easy to carry out. Furthermore, even when rotors R1*a*, R1*b*-R5*a*, R5*b* are cut and then fixed on revolving shafts A1 and A2 at the first time, the same interlock position enables the ease for phase adjustment. Accordingly, one can fix rotors R1*a*, R1*b*-R5*a*, R5*b* with ease and comparatively good precision, as well as cost reduction.

Apart from this, for instance, upstream pump rotors R1*a*, R1*b*, R2*a*, R2*b* are made by cutting a sheet fixed on revolving shafts A1 and A2 while downstream rotors R3*a*, R3*b*-R5*a*, R5*b* are made before being fixed to revolving shafts A1 and A2, but are fixed on revolving shafts A1 and A2 after being manufactured. Through this kind of process, it can further reduce manufacturing time.

Additionally, with respect to pump 1 in the first embodiment of the invention, since the diameter of the big diameter sections A1*a* and A2*a* of revolving shafts A1 and A2 where No. 3 pump rotors R3*a*, R3*b*-No. 5 pump rotor R5*a*, R5*b* are fixed is big, rigidity of revolving shafts A1 and A2 are increased.

Furthermore, with respect to pump 1 in the first embodiment of the invention, by means of the arrangement of the mid-stage discharge outlet P2*c*, even with increased volume ratio at upstream No. 2 pump chamber P2 and downstream No. 3 pump chamber P3, and high pressure at discharge outlet P2*b* causing overcompression, gas can still be discharged from discharge outlet P2*c*. As a result, even at the time right after discharge starts when pressure is high, reduction of discharge velocity is avoided.

Additionally, with respect to pump 1 in the first embodiment of the invention, the profile of downstream rotors R3*a*, R3*b*-R5*a*, R5*b* is defined by the combination of arc 31*a* and envelop curve 32*a*, the radius of rotor outside diameter circle 34 is relatively flexible in design compared with reference circle 33, so that it is easy to adjust discharge area HM2; thus increase the flexibility to define discharge area HM2 and discharge volume, as well as the flexibility to design pump 1.

In the first embodiment of the invention, one can replace the involute toothed rotor of upstream pump rotors R1*a*, R1*b*, R2*a*, R2*b* with rotors obtained from the combination of arcs similar to downstream rotors R3*a*, R3*b*-R5*a*, R5*b*.

Namely, as shown in FIG. 4C, first, define a rotor outside diameter circle 24' (referring to dot dot dash line in FIG. 4C) that is concentric to reference circle 23' (referring to dot dash line in FIG. 4C) and bigger in radius compared with rotor outside diameter circle 34 of downstream rotor. Second, similarly to the first embodiment of the invention, set the tip of lobe 21' and the point of connection 27'. Thereby the profile of upstream pump rotors R1*a*, R1*b*, R2*a*, R2*b* is defined by arc 21*a*' passing through the tip of lobe 21' and the point of connection 27' at both sides, and also through envelope curve 22*a*' formed by arc of interlocked lobe of the twin rotors.

Regarding the pump 1 having the structure defined in the first variation of the second embodiment of the invention, as mentioned before, it is relatively flexible to define discharge area with the profile of toothed rotor defined by the combination of arc and envelop curve. On the other hand, in the case of the involute toothed and below-mentioned cycloidal toothed rotor, similarly to upstream rotors R1*a*, R1*b*, R2*a*, R2*b* in the first embodiment of the invention, once the radius of reference circle 33 and lobe number are decided, the radius of rotor 34 is decided one-dimensionally thus resulting in low flexibility for design. In contrast with this case, since toothed rotor formed through combination of arc 21*a*' and envelope curve 22*a*' that are high in freedom of design is applied in variation 1 of the first embodiment of the invention, one can decide the discharge area HM1' (referring to the patterned area in FIG. 4C) of upstream pump rotors R1*a*', R1*b*', R2*a*', R2*b*' freely, and it is possible to have the same discharge area of HM1 in the first embodiment of the invention. As a result, the pump in variation of the first embodiment of the invention has the same effect as pump 1 in the first embodiment of the invention.

In the first embodiment of the invention, one can replace downstream pump rotors R3*a*, R3*b*-R5*a*, R5*b* with so-called cycloidal toothed rotors. Namely, as shown in FIG. 4D, similar to the first embodiment of the invention, define reference circle 33' (referring to dot dash line in FIG. 4D), a rotor outside diameter circle 34' (referring to dot dot dash line in FIG. 4D), the tip of lobe 32', the bottom of valley 32' and the point of connection 37'. Therefore, the profile of downstream pump rotors R3*a*", R3*b*"-R5*a*", R5*b*" is defined by the cycloidal curve (outer cycloidal, epicycloidal) 31*a*" passing through the tip of lobe 31' and the point of connection 37' at both sides, and the cycloidal curve (inner cycloidal, hypocycloidal) 32*a*" passing through the tip of lobe 31' and the point of connection 37' at both sides.

Regarding the pump having the structure defined in the first variation of the first embodiment of the invention, compared with downstream pump rotors R3*a*, R3*b*-R5*a*, R5*b* in the first embodiment of the invention, discharge area HM2" is bigger, however discharge area HM1 of upstream pump rotors R1*a*, R1*b*, R2*a*, R2*b* is smaller compared with discharge area HM2". As a result, the pump in the second variation of the first embodiment of the invention has the same effect as pump 1 in the first embodiment of the invention.

Embodiments of the invention have been described in detail, but it is to be understood that the invention is not limited exclusively to the described embodiments. Within the scope of the claims of the invention, variations can be made. Variations (H01) to (H06) of the invention are illustrated below.

(H01) In the embodiments, the lobe number of pump rotors R1*a*, R1*b*-R5*a*, R5*b* may not be limited to three, it is possible to be two, four or more than four.

(H02) In the embodiments, it is possible to omit mid-stage discharge outlet P2*c*.

(H03) In the embodiments, outside diameter of downstream sections A1 and A1 on revolving shafts is designed to be bigger, however, it is possible to design the upstream and downstream sections having identical diameter.

(H04) In the embodiments, involute toothed rotor or combined arc toothed rotor is applied, however, it is also possible to apply cycloidal toothed rotor that has bigger discharge area than downstream side.

(H05) In the embodiments, upstream twin rotors R1 and R2 are designed as two stages, and downstream twin rotors R3-R5 are designed as three stages; however, it is possible to change stage number randomly; the upstream and downstream twin rotors may also be designed as one stage.

(H06) In the embodiments, a pump rotor of two profiles is illustrated, but it is not limited to the present case. It is possible to apply pump rotor of three or more than three profiles on upstream side, midstream side and downstream side. For instance, it is possible to apply an involute toothed pump rotor on upstream side, a cycloidal toothed pump rotor on midstream side and an arc combined toothed pump rotor on downstream side.

What is claimed is:

1. A multistage roots-type vacuum pump comprising:

a casing containing multiple pump chambers;

a pair of revolving shafts supported by said casing;

an upstream rotor having a profile formed by an involute or cycloidal curve, mounted within said pump chamber on an upstream side of a gas travel path, supported by each of said revolving shafts, and having multiple teeth; and a downstream rotor having a profile formed by an envelope curve, which is different from said involute or cycloidal curve, mounted within said pump chamber on a downstream side of the gas travel path, supported by each of said revolving shafts, having an identical number of teeth with said upstream rotor.

2. The multistage roots-type vacuum pump of claim 1, further comprising multiple upstream rotors and multiple downstream rotors.

3. A multistage roots-type vacuum pump comprising:

a casing containing multiple pump chambers;

a pair of revolving shafts supported by said casing;

an upstream rotor having a profile formed by an involute or cycloidal curve, the upstream rotor mounted within said pump chamber on an upstream side of a gas travel path, supported by each of said revolving shafts, and having multiple teeth; and a downstream rotor having a profile formed by an envelope curve, the downstream rotor mounted within said pump chamber on a downstream side of the gas travel path, supported by each of said revolving shafts, having an identical number of teeth with said upstream rotor, wherein a discharge area formed by an outer periphery of said downstream rotor and an inner periphery of said pump chamber is smaller than a discharge area of said upstream rotor.

4. The multistage roots-type vacuum pump of claim 3, further comprising multiple upstream rotors and multiple downstream rotors.

5. A multistage roots-type vacuum pump comprising:

a casing containing multiple pump chambers;

a pair of revolving shafts supported by said casing;

multiple upstream rotors having a profile formed by an involute or cycloidal curve, each mounted within said pump chamber on an upstream side of a gas travel path, supported by each of said revolving shafts, and having multiple teeth; and multiple downstream rotors having a profile formed by an envelope curve, which is different from said involute or cycloidal curve, each mounted within said pump chamber on a downstream side of the gas travel path, supported by each of said revolving shafts, and having an identical number of teeth with said upstream rotor.

* * * * *

UNITED STATES PATENT AND TRADEMARK OFFICE

CERTIFICATE OF CORRECTION

PATENT NO. : 7,491,041 B2
APPLICATION NO. : 11/509331
DATED : February 17, 2009
INVENTOR(S) : Imai et al.

It is certified that error appears in the above-identified patent and that said Letters Patent is hereby corrected as shown below:

In the specification:

| | | |
|---|---|---|
| COLUMN 1, | LINE 12, | change "semi-conductor" to --semiconductor-- |
| COLUMN 1, | LINE 64, | change "9)" to --9).-- |
| COLUMN 1, | LINE 66, | change "3)" to --3).-- |
| COLUMN 3, | LINE 5, | change "volume at" to --volume at a-- |
| COLUMN 3, | LINE 9, | change "rotor are" to --rotor is-- |
| COLUMN 3, | LINE 27, | change "sectional" to --cross-sectional-- |
| COLUMN 3, | LINE 30, | change "pump in" to --pump in the first-- |
| COLUMN 3, | LINE 31, | change "invention" to --invention.-- |
| COLUMN 3, | LINE 36, | change "the upstream" to --of the upstream-- |
| COLUMN 3, | LINE 36, | change "embodimentof" to --the first embodiments of-- |
| COLUMN 3, | LINE 37, | change "the downstream" to --of the downstream-- |
| COLUMN 3, | LINES 37-38, | change "embodiment" to --the first embodiment-- |
| COLUMN 3, | LINES 38-39, | change "variation" to --a first variation-- |
| COLUMN 3, | LINE 42, | change "of lobe" to --of the lobe-- |
| COLUMN 3, | LINE 42, | change "of rotors" to --of the rotors-- |
| COLUMN 3, | LINE 43, | change "three-lobed" to --a three-lobed-- |
| COLUMN 3, | LINE 45, | change "involute-toothed" to --involute-toothed rotor-- |
| COLUMN 3, | LINE 45, | change "six-lobed" to --a six-lobed-- |
| COLUMN 3, | LINE 55, | change "FIGs" to --figures-- |
| COLUMN 3, | LINE 62, | change "envelop" to --envelope-- |
| COLUMN 4, | LINE 9, | change "Embodiment" to --embodiment-- |
| COLUMN 4, | LINE 11, | change "pump in" to --pump in the first-- |
| COLUMN 4, | LINE 41, | change "**6***a* to **9***a*" to --**6***b* to **9***b*-- |
| COLUMN 4, | LINE 42, | change "**10***a*" to --**10***b*-- |
| COLUMN 5, | LINE 7, | change "said gear" to --gear-- |
| COLUMN 5, | LINE 24, | change "then" to --the-- |
| COLUMN 5, | LINE 25, | change "in variation" to --in the first variation-- |
| COLUMN 5, | LINE 32, | change "comprises" to --comprise-- |

Signed and Sealed this
Eleventh Day of February, 2014

Michelle K. Lee

Michelle K. Lee
*Deputy Director of the United States Patent and Trademark Office*

In the specification (continued):

| | | |
|---|---|---|
| COLUMN 5, | LINE 36, | change “lobes” to --teeth-- |
| COLUMN 5, | LINE 46, | change “crosspoint” to --cross-point-- |
| COLUMN 5, | LINE 46, | change “lobe” to --tooth-- |
| COLUMN 5, | LINE 47, | change “crosspoint” to --cross-point-- |
| COLUMN 5, | LINE 52, | change “said bisector” to --bisector-- |
| COLUMN 5, | LINE 54, | change “involute” to --involute curve-- |
| COLUMN 5, | LINE 57, | change “comprises” to --comprise-- |
| COLUMN 5, | LINE 60, | change “lobe” to --tooth-- |
| COLUMN 6, | LINE 3, | change “lobe” to --tooth-- |
| COLUMN 6, | LINE 13, | change “lobes **31**(tooth)” to --teeth **31**-- |
| COLUMN 6, | LINE 21, | change “lobe” to --tooth-- |
| COLUMN 6, | LINE 23, | change “lobe” to --tooth-- |
| COLUMN 6, | LINE 31, | change “1” to --of the invention-- |
| COLUMN 6, | LINE 38, | change “lobe” to --tooth-- |
| COLUMN 6, | LINE 47, | change “R**3***b*□No. **5**” to --R**3***b*, No. **5**-- |
| COLUMN 6, | LINE 57, | change “since” to --since the-- |
| COLUMN 7, | LINE 12, | change “move” to --moving-- |
| COLUMN 7, | LINE 21, | change “in short” to --in a short-- |
| COLUMN 7, | LINE 22, | change “enable” to --enabling-- |
| COLUMN 7, | LINE 29, | change “round sheet or” to --a round sheet or a-- |
| COLUMN 7, | LINE 30, | change “used,” to --used;-- |
| COLUMN 7, | LINE 34, | change “result” to --results-- |
| COLUMN 7, | LINE 35, | change “cutting” to --cutting and-- |
| COLUMN 7, | LINE 40, | change “make” to --making-- |
| COLUMN 7, | LINE 45, | change “number,” to --number where,-- |
| COLUMN 7, | LINE 60, | change “A**2**” to --A**2**,-- |
| COLUMN 8, | LINE 16, | change “envelop” to --envelope-- |
| COLUMN 8, | LINE 16, | delete “outside diameter circle” |
| COLUMN 8, | LINE 28, | change “with rotor” to --with radius of rotor-- |
| COLUMN 8, | LINE 29, | delete “outside diameter circle” |
| COLUMN 8, | LINE 31, | change “lobe” to --tooth-- |
| COLUMN 8, | LINE 33, | change “lobe” to --tooth-- |
| COLUMN 8, | LINE 40, | change “envelop” to --envelope-- |
| COLUMN 8, | LINE 49, | change “variation 1” to --the first variation-- |
| COLUMN 8, | LINE 54, | change “in variation” to --in the first variation-- |
| COLUMN 8, | LINE 61, | change “**33**′” to --**33**″-- |
| COLUMN 8, | LINE 62, | change “**34**′” to --**34**″-- |
| COLUMN 8, | LINE 63, | change “lobe **32**′” to --tooth **30**″-- |
| COLUMN 8, | LINE 67, | change “lobe **31**′” to --tooth **31**″-- |
| COLUMN 8, | LINE 67, | change “**37**′” to --**37**″-- |